United States Patent [19]

Furrow et al.

[11] Patent Number: 4,687,033

[45] Date of Patent: Aug. 18, 1987

[54] VENTURI LIQUID EVACUATOR SYSTEM FOR MAINTAINING CLEAR VAPOR PATH IN VAPOR RECOVERY HOSE

[75] Inventors: Roger W. Furrow, High Point; Harold R. Young, Kernersville; G. Frank Dye, Greensboro, all of N.C.

[73] Assignee: Gilbarco, Inc., Greensboro, N.C.

[21] Appl. No.: 864,569

[22] Filed: May 19, 1986

Related U.S. Application Data

[63] Continuation of Ser. No. 590,063, Mar. 15, 1984, abandoned.

[51] Int. Cl.[4] ..... B65B 57/14; B67D 5/06

[52] U.S. Cl. ..... 141/59; 141/44

[58] Field of Search ..... 141/37, 44–46, 141/54–60, 392, 67, 126, 127; 220/85 VR, 85 VS; 417/182, 187

[56] References Cited

U.S. PATENT DOCUMENTS

| | | | |
|---|---|---|---|
| 3,863,687 | 2/1975 | Alquist | 141/45 |
| 3,913,633 | 10/1975 | Hiller | 141/45 |
| 3,952,781 | 4/1976 | Hiller et al. | 141/46 |
| 3,981,335 | 9/1976 | Deters | 141/46 |
| 4,057,086 | 11/1977 | Healy | 141/44 X |
| 4,095,626 | 6/1978 | Healy | 141/59 X |
| 4,253,503 | 3/1981 | Gunn | 141/59 |
| 4,566,504 | 1/1986 | Furrow et al. | 141/59 |

FOREIGN PATENT DOCUMENTS 2016417A 9/1979 European Pat. Off. .

*Primary Examiner*—Stephen Marcus
*Assistant Examiner*—Ernest Cusick

[57] ABSTRACT

In a coaxial hose system for a fuel distribution system, a product delivery hose is centrally located within a vapor recovery hose, whereby the area between the product and vapor hoses provides a return path for vapors developed at a nozzle during refueling of a vehicle. A venturi pump is located in the product hose, and operable over a range of flow rate of the fuel through the product hose, for sucking fuel back into the product hose from an area of the vapor path where fuel may accumulate due to backflow from the nozzle, thereby substantially insuring a clear vapor path and more complete delivery of metered fuel.

11 Claims, 12 Drawing Figures

FIG. 3A
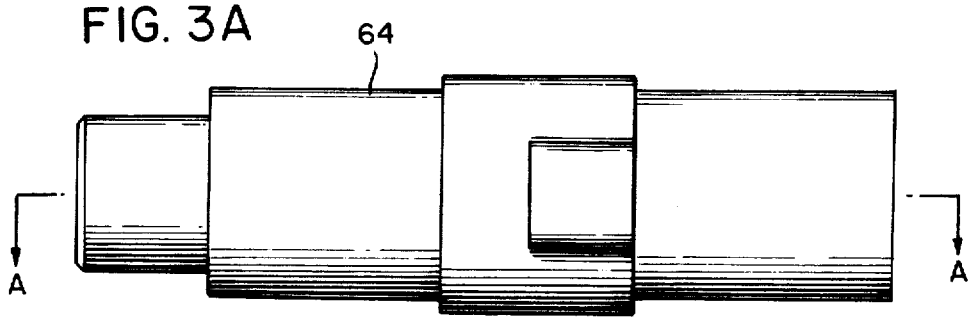
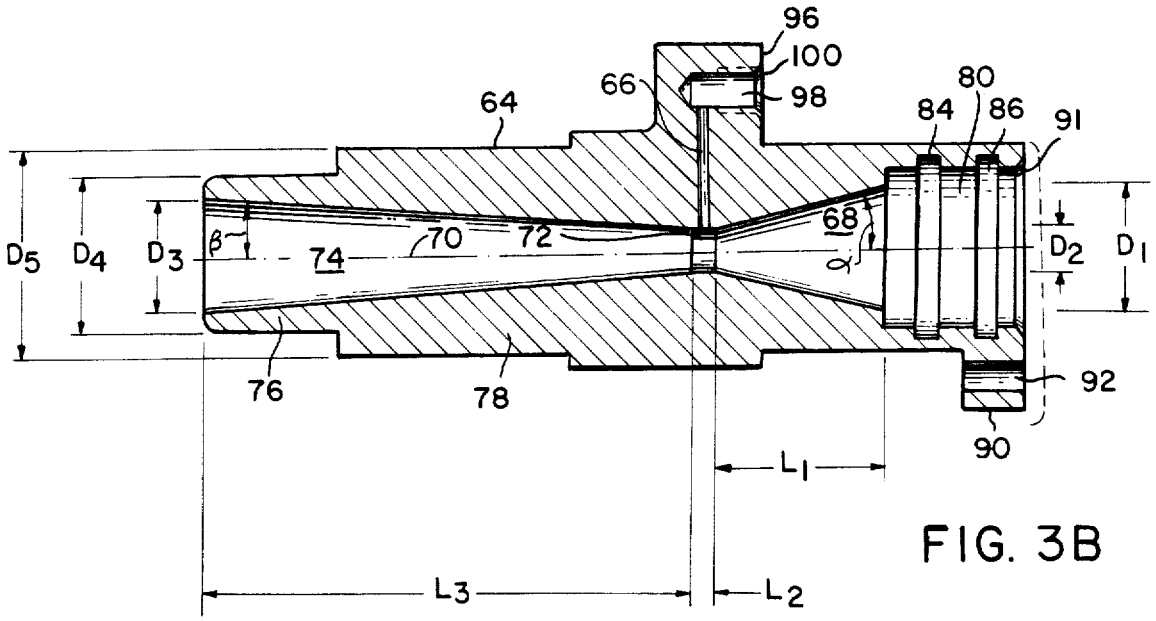
FIG. 3B
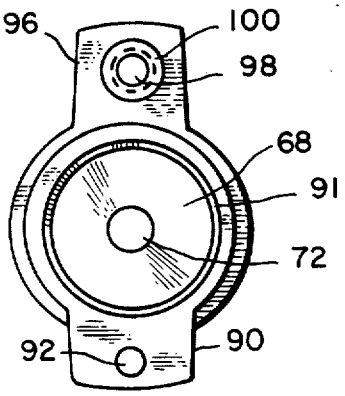
FIG. 3C

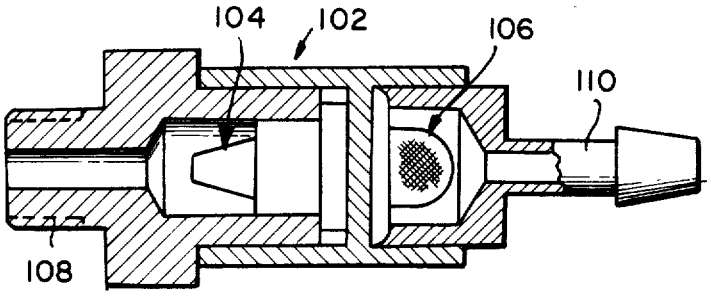
FIG. 4 A
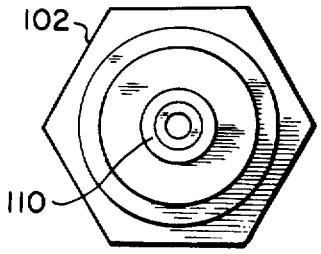
FIG. 4B
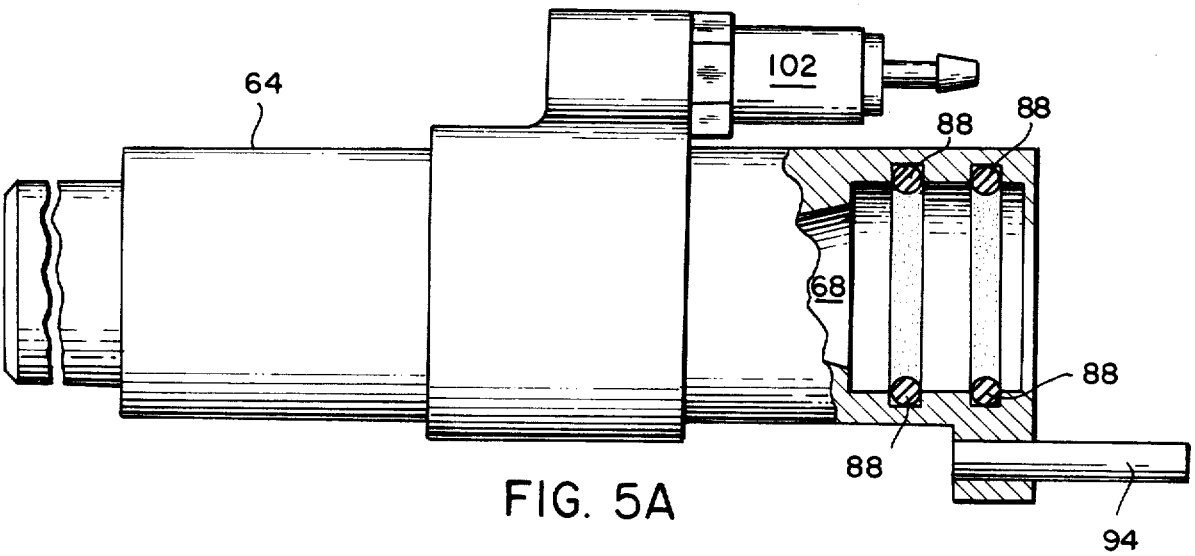
FIG. 5A
FIG. 5B
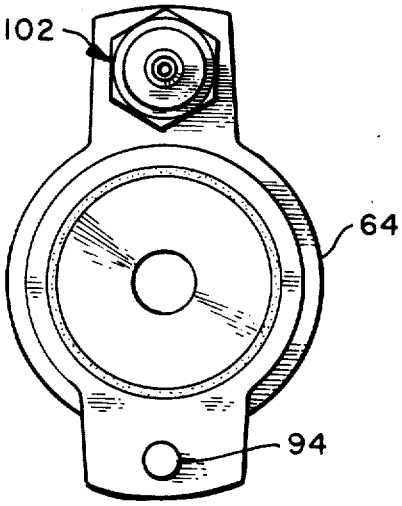

VENTURI LIQUID EVACUATOR SYSTEM FOR MAINTAINING CLEAR VAPOR PATH IN VAPOR RECOVERY HOSE

This application is a continuation of application Ser. No. 590,063, filed Mar. 15, 1984, now abandoned.

FIELD OF INVENTION

The field of the present invention relates generally to vapor recovery systems, and more specifically to fuel dispensing systems including a venturi aspirator for removing accumulated fuel from the vapor path of vapor recovery hoses included in such systems between the nozzle and meter housing.

In fluid distribution systems, such as gasoline pumping systems for delivering gasoline to the fuel tank of the vehicle, environmental protection laws require that vapors emitted during the fuel dispensing process be recovered. One such vapor recovery system includes a vapor recovery hose surrounding a product hose for delivering fuel to a nozzle, typically the nozzle of a gasoline pump. Vapors collected from the vehicle tank at the nozzle end are pushed by positive pressure which develops within the vehicle tank, normally called a balanced system, or sucked by a vacuum, from the nozzle back into the gasoline storage tank of the product distribution system via the vapor return path provided by the space between the coaxial product and vapor recovery hoses. At times liquid fuel may overflow from the nozzle into the vapor recovery path of the vapor recovery hose and collect at a low point in the vapor recovery hose causing partial or total blockage of the return path for the vapors. Even partial blockage of the vapor recovery path of the vapor hose must be avoided in order to insure the product or fuel distribution system meets the environmental protection requirements imposed by local, state, and federal governments.

In Co-pending application Ser. No. 532,290, for "Insertion Tube Liquid Evacuator System For Vapor Recovery Hose" filed Sept. 15, 1983, now U.S. Pat. No. 4,566,504 and assigned to the assignee of the present invention, one embodiment shows one end of a flexible hose inserted into a vapor recovery hose in an area where liquid fuel may accumulate, and the other end of the hose connected to a pump, for pumping the fuel out of the vapor recovery hose to maintain a clear vapor path. The previously mentioned application teaches that during refueling of an automobile 1, the liquid suction pump 15 is energized to suck away any liquid fuel entrapped in the vapor recovery line 5 via flexible hose 8. The unwanted fuel is discharged via outlet port 19 into the lower portion of the vapor recovery line 13, for return to an underground storage tank, in that example.

In U.S. Pat. No. 3,863,687, for "Return of Vapor Condensate Formed in Dispensing Vaporous Liquid", issued Feb. 4, 1975, the invention disclosed includes a reservoir for collecting condensate from vapors that are flowing through a vapor return line of a fuel delivery system. The reservoir is located within the gasoline dispenser housing of the system, remote from the separate and individual product delivery hose 36, and vapor return line 39. Condensation that forms in a portion of a substantially overhead vapor return line 40 partly returns to the reservoir 20, from which it is returned to the product delivery hose via a product operated pump also located within the dispenser housing adjacent to the reservoir. In one embodiment, a venturi pump 3 is used to suck condensate from the reservoir into the product delivery line portion located within the meter housing. No teaching or suggestion of any apparatus or method for maintaining the vapor return line hose 39 free of liquid fuel is made or even alluded to.

The present invention includes venturi pump means located within the fuel flow path of a product hose for pumping out or aspirating liquid fuel that may accumulate in the vapor path of a vapor recovery hose that is either separate from or coaxial with and surrounding the product hose, and returning this fuel to the fuel flowing in the product hose, for maintaining the vapor path of the vapor hose clear for vapor flow between a nozzle and the metering housing.

In the figures, wherein like items are indicated by the same reference number:

FIG. 3A is a top view of a venturi pump body of a preferred embodiment of the invention;

FIG. 3B is a sectional view along AA of FIG. 3A;

FIG. 3C is an end view taken from the right of the venturi pump body of FIG. 4B;

FIG. 4A is a cross-sectional view of a check valve and filter assembly of the preferred embodiment of the invention;

FIG. 4B is an end view taken from the right of the check valve and filter assembly of FIG. 4A;

FIG. 5A is a side view with partial cutaway of the venturi pump assembly of the preferred embodiment of the invention;

FIG. 5B is an end view from the right of the venturi assembly of FIG. 5A;

Figure 1:
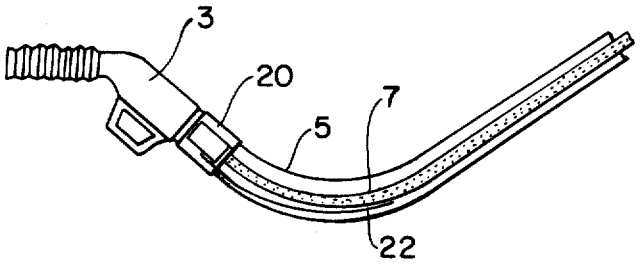
FIG. 1 is a partial cutaway view of a nozzle and coaxial hose assembly incorporating one embodiment of the invention.

With reference to FIG. 1, the invention generally includes a venturi liquid removal system 20 incorporated within hose 7 of the coaxial hoses 5, 7 and nozzle 3 assembly of a fuel distribution system. A flexible tubing 22 is connected to the venturi pump or aspirator assembly 20, with the free end of the tubing 22 being located in an area of the vapor recovery hose 5 where liquid such as gasoline is expected to accumulate due to flowback from the nozzle 3 during the dispensing of fuel to a vehicle. When fuel flows through the product hose 7, for delivery through the nozzle 3 to a vehicle, the venturi pump assembly 20 is operative by the flow of fuel to cause liquid accumulated in the vicinity of the free end of tubing 22 to be sucked back or aspirated through the tubing and into the fuel flowing from the venturi assembly 20 into the nozzle 3. In this way, the vapor path of the vapor hose 5 is maintained substantially clear of blockage by fuel that may overflow or "spitback" from the nozzle 3 into the vapor path, thereby permitting the free flow of vapors from the nozzle 3 back through the vapor path of vapor hose 5 to a collection point.

Figure 2:
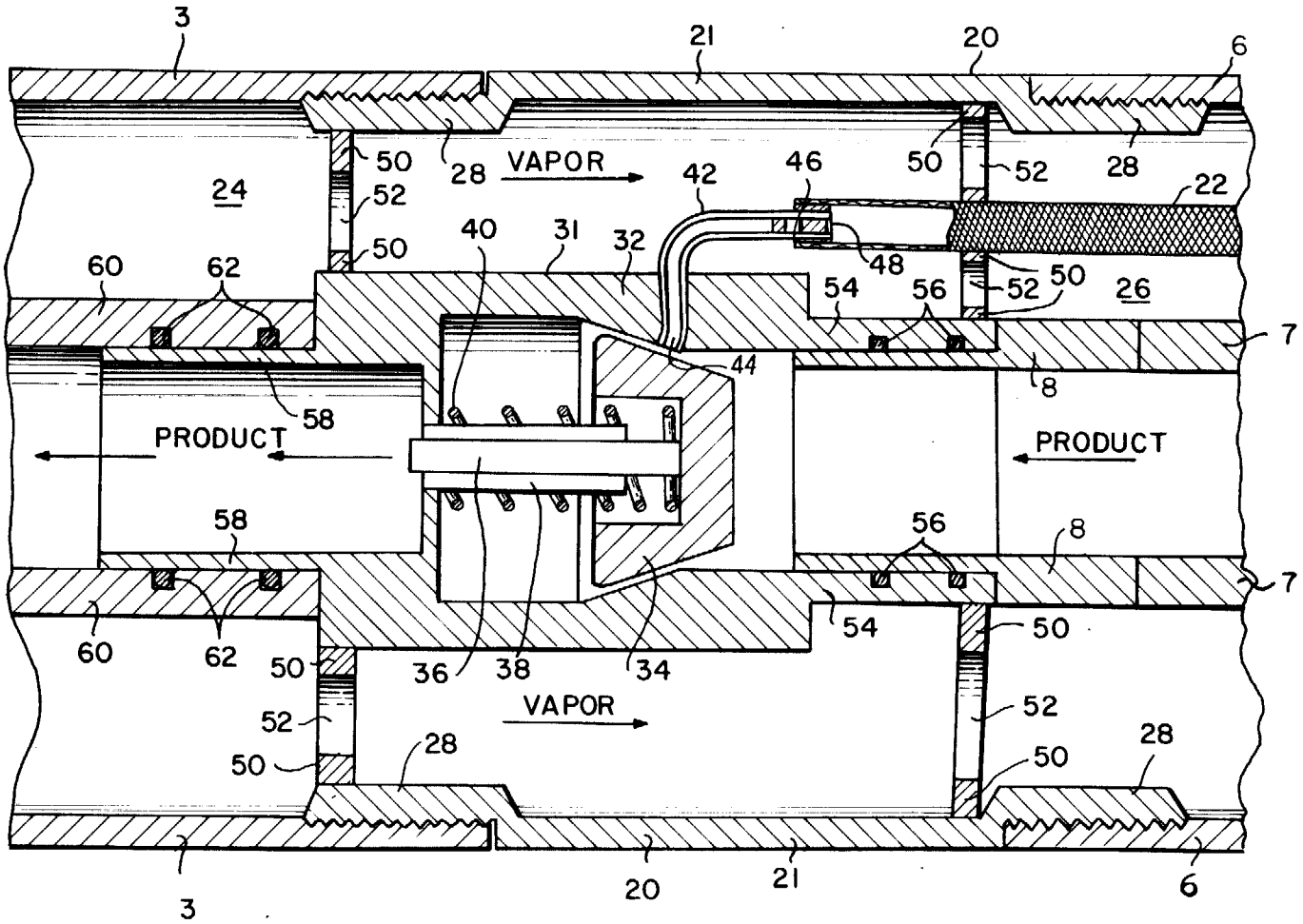
FIG. 2 is a detailed cutaway view of an embodiment of the invention.

One embodiment of the invention is shown in FIG. 2, and includes a venturi assembly 20 mounted between the inlet end 24 of a nozzle 3 and the product delivery end 26 of a coaxial hose system, including an inner product delivery hose 7 surrounded by an outer vapor hose 5. As shown in this example, the venturi assembly 20 includes an outer tubular member 21 fabricated from a rigid material, such as appropriate metals, having threaded end portions 28 for connection to mating members of the nozzle 3 and vapor hose connection 6 as shown. The venturi pump or aspirator 31 includes a rigid tubular housing 32 shaped as shown for enclosing a spring loaded poppet valve 34. The poppet valve 34 has a centrally located rod-like member 36 ideally mounted within a tubular sleeve member 38, and a spring 40 for providing appropriate spring biasing of the poppet valve 34. A rigid inlet tube 42 is provided for connecting the inlet hole 44 to the flexible hose or tubing 22, the latter which can be fabricated from polyethylene or butyl rubber, for example. A flapper valve 46 serving as a check valve is preferably installed within the inlet tubing 42, for preventing gasoline or other liquid fuel product flowing through the product hose 7 from being forced into the vapor path of the vapor hose 5. In other words, the flapper valve 46 serves to insure that fluid can only flow in one direction, namely from the vapor path of vapor hose 5 to the venturi pump 31. A suitable check valve 46 is believed to be a duck bill check valve manufactured by Vernay Laboratories, Inc., Yellow Springs, Ohio, 45387, under Vernay Part No. VA3426. Also installed in the inlet tubing 42 is a filter screen 48 serving to filter out any contamination contained within the fuel sucked back to the venturi pump 31 via the tubing 22. The filter substantially ensures reliable long-term operation of check valve 46. Ringlike bushing members or spacers 50 are provided for maintaining the venturi housing 31 centered within the venturi assembly 20, as shown. The rings or bushings 50 include a plurality of holes or openings 52 for permitting the free flow of vapors from a nozzle 3 to the vapor hose 5 as shown. The flexible tubing 22 is passed through one of the holes in the ring or bushing member 50 associated therewith. The product hose 7 for carrying fuel to nozzle 3 is connected to the inlet 54 of venturi 31 via O-ring seals 56, whereby the inlet 54 receives rigid hose connector 8. Similarly, the product outlet portion 58 of venturi housing 31 is coupled to the product inlet 60 of nozzle 3 via O-ring seals 62.

With reference to FIG. 2, when the fuel distribution system is operating to pump product through the product hose 7 in the direction of the arrows, the venturi pump or aspirator 31 is operative to draw fluid from areas within the vapor hose 5 where the fluid may accumulate (see FIG. 1), through the inlet tube 42 and hole 44 for return to the product stream flowing through the product hose 7, as shown. The spring loaded poppet valve 34 permits the venturi pump to draw fluid even at relatively low flow rates of product. As will be shown, unless it is necessary to produce adequate suction via the venturi pump 31 throughout a very wide range of product flow rate, including very low flow rates of product, the spring loaded poppet valve 34 may not be required.

As shown, in operation of the embodiment of the invention of FIG. 2, product accumulation in the vapor hose 5 is removed automatically during normal fueling of a vehicle, thereby preventing excessive back pressure on the balanced vapor recovery nozzle 3 because of such product accumulation. Accordingly, vapor leakage at the nozzle-filler neck (not shown) between the vehicle gasoline tank and outlet of nozzle 3 is substantially eliminated. Note that the venturi pump 31 can be located at any point down stream of the meter housing 11.

When the spring loaded poppet 34 is implemented, the poppet 34 is always located as shown for opposing the direction of product flow through the product hose 7 of the coaxial hose system 5, 7. Controlled loading by the spring 40 produces a small cross sectional flow area and consequent high velocity of product past the inlet hole 44. The high velocity product flow produces a low static pressure on the inlet tube 42, thereby providing the suction for aspirating accumulated product out of the vapor hose 5. The one way check valve 46, as previously mentioned, prevents product from being pumped into the vapor path portion of the vapor hose 5 when the fuel is not flowing or the flow rate is low. Note also, that the venturi pump 31 can be located within the nozzle assembly 3, in certain applications. The suction tube 22 would then be routed back from the nozzle 3 to the best position for removing accumulated product from the vapor path of the vapor hose 5. Also, the venturi pump 31, in this example, could be placed between the nozzle valve housing and filler tube in the vapor recovery nozzle (not shown). The advantage of this latter approach is that at low flow conditions, no pressure would be applied to the poppet valve 34 or tube orifice 44, whereby the check valve 46 could be eliminated.

A second and preferred embodiment of the invention is shown in FIGS. 3A through FIG. 6. In FIG. 3A, a top view of the housing of the venturi pump 64 ultimately developed for use in product by the inventors is shown.

In FIG. 3B, a sectional view taken along AA of FIG. 3A is shown. Note that in this embodiment of the invention no poppet valve is utilized, accordingly the venturi pump 64 is of a fixed throat design, in contrast to the variable throat design of FIG. 2 provided by the poppet valve 34. The dimensioning of the venturi chamber of the venturi pump 64 is considered critical to obtaining a low static pressure at the orifice 66 sufficient for continuously aspirating or sucking fluid out of the vapor hose 5 (for example) over a given range of flow rate of product. The present inventors designed the venturi pump 64 to provide low enough static pressure for adequate aspiration away from the vapor path of the vapor hose 5 over a product flow rate range of 6.5 to above 10.0 gallons per minute of gasoline, in this example. Certain critical dimensions ($D_1$, $D_2$, $D_3$, $L_1$, $L_2$, $L_3$, $\alpha$, and $\beta$) for the venturi pump 64 to provide such operation are discussed in the following paragraph.

Figure 6:
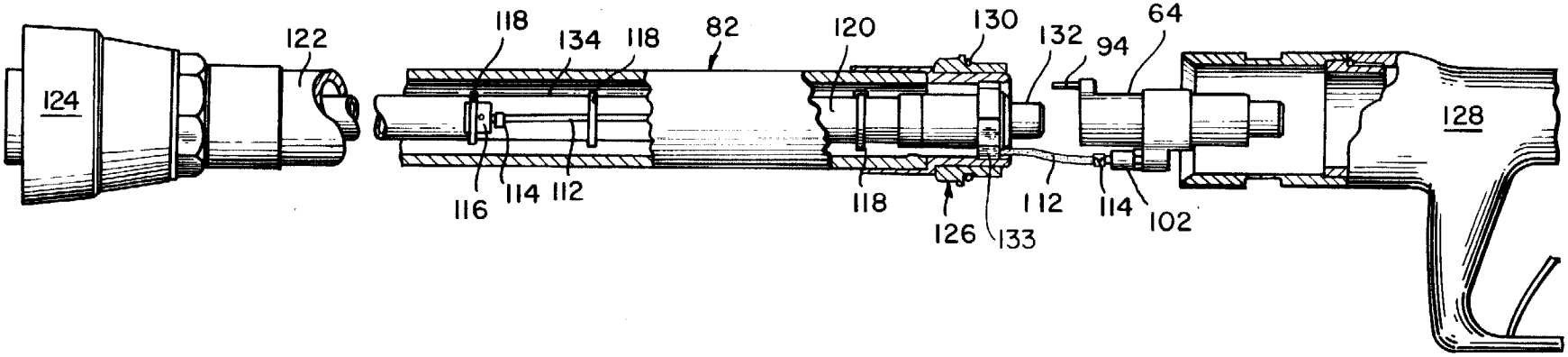
FIG. 6 is a partial cutaway and exploded assembly view of the preferred embodiment of the invention.

The venturi pump 64 includes as shown in FIG. 3B, an inwardly tapering conical inlet throat 68 relative to the direction of fuel flow having an entry diameter $D_1$ of 0.53 inch, an exit diameter $D_2$ of 0.213 inch, an angle $\alpha$ of 12 degrees 15 minutes with its longitudinal axis 70 measured from its exit end, and a length $L_1$ with respect to its longitudinal axis 70 of 0.720 inch, a central cylindrical portion 72 having a length of 0.10 inch, and a diameter equivalent to the exit diameter $D_2$ of the inlet throat 68. The inlet port 66 for the venturi pump 64 includes a hole through the wall of the cylindrical portion 72, having a 0.062 inch diameter. The venturi pump 64 further includes an outwardly tapering conical outlet throat 74 having an entry diameter equivalent to the diameter of cylindrical portion 72 or the exit diameter $D_2$ of the inlet throat 68, an exit diameter $D_3$ of 0.50 inch, a length $L_3$ with respect to its longitudinal axis 70 of 2.07 inches, and an angle $\beta$ of 4 degrees with its longitudinal axis 70 measured from its entry end adjacent cylindrical portion 72. The reduced portions of the body of the venturi pump 64 associated with the outlet throat 74 includes sections 76 and 78 having diameters of $D_4$, and $D_5$, respectively, which are dimensioned for connection or coupling to a particular nozzle or hose assembly. Obviously, the overall outer configuration and dimensioning of the venturi pump 64 may be tailored to or adapted for the particular mounting configuration and application. Also in this example, preceding the inlet throat 68 is a coupling section 80 configured for coupling to a coaxial hose assembly 82 as shown in FIG. 6, in this example. The coupling section 80 includes two raceways 84 and 86 for receiving "O" rings 88 as shown in FIG. 5A. A chamfer 91 in included at the entry of the coupling chamber 80 portion of venturi pump 64. Also, a stud like projecting portion 90 is included in the venturi pump 64 housing, and has a hole 92 for receiving a groove pin 94, as shown in FIG. 5A, wherein the groove pin 94 is pressed into the hole 92. Another stud like projecting portion 96 is included in the housing configuration for venturi pump 64, having a hole 98 partially through this portion 96 and intersecting the inlet hole 66, as shown. A chamfer 100 is included at the entry to the hole 98. Hole 98 provides the inlet port for venturi pump 64. In FIG. 3C an end view of the venturi pump 64 taken from the inlet throat 68 is shown.

With further regard to the example of the preferred embodiment of the invention, a check valve and filter assembly 102 is provided as shown in FIG. 4A. The check valve 104 is identical to the check or flapper valve 46 of FIG. 2, in this example, and as previously mentioned is manufactured by Vernay Laboratories, Inc., Yellow Springs, Ohio, U.S.A. under Vernay Part No. VA3426. A cap like filter screen 106 is also included for serving the same function as filter 48 of FIG. 2. The outlet end 108 is coupled to the inlet hole or port 98 of venturi pump 64. The other end 110 is configured for coupling to a flexible tube 112, as shown in FIG. 6. An end view of the filter assembly 102 taken from the end 110 is shown in FIG. 4B.

In FIG. 5A, the venturi pump 64 is shown in its assembled configuration with check valve and filter assembly 102, and including "O"-rings 88, and groove pin 94. An end view of the assembly taken from the inlet 68 end is shown in FIG. 5B.

In FIG. 6, a partially exploded, partially cutaway assembly view is shown of one application of the subject invention. The flexible product return tubing 112 is clamped to the check valve and filter assembly 102 via a tubing clamp 114. The other end of the product return tubing 112 is clamped via another tubing clamp 114 to a suction head 116 as shown. Clamps 118 are used for securing the product return tubing 112 and suction haed 116 to the product hose 120, for example. Outer vapor hose 122 surrounds the product hose 120, to form a coaxial hose assembly 82. One end of this coaxial hose assembly 82 is rigidly connected to a coupling connector 124 for connection to the product feed and vapor return lines of a fuel dispensing system (not shown), for example. The other end of the coaxial hose assembly 82 is coupled to another coupling connector 126 for coupling to the venturi pump 64, and nozzle 128. The coupler 126 includes an "O"-ring seal 130, as shown. The tube like projection 132 of coupler 126 is dimensioned for plugging into the coupling chamber 80 of venturi pump housing 64, whereby groove pin 94 of venturi pump 64 is insertable into a guide pin hole of the spacer 133 (this hole is not shown). Spacer 133 is fixed to product hose 120 with set screws (not shown). Rotation of venturi pump 64 with respect to product hose 120 is prevented by the coupling between groove pin 94 and the hole in spacer 133. A similar antirotation device is provided in coupling 124 to prevent rotation of product hose 120 with respect to coupling 124 which is rigidly fixed to dispenser 136. The vapor recovery path 134 is provided by the area between the inner product hose 120, and the outer vapor hose 122. The suction head 116 is located and maintained in an area of vapor hose 122 (via the previously described antirotation mechanisms) where liquid fuel is expected to accumulate from "spit back" or "over flow" from the nozzle 128, as previously explained.

Depending upon the application, many different assembly configuration designs may be used to incorporate the present invention for use in a liquid removal system. The description of the application of the present invention as included herein is meant for the purpose of example only, and is not meant to be limiting.

Figure 7:
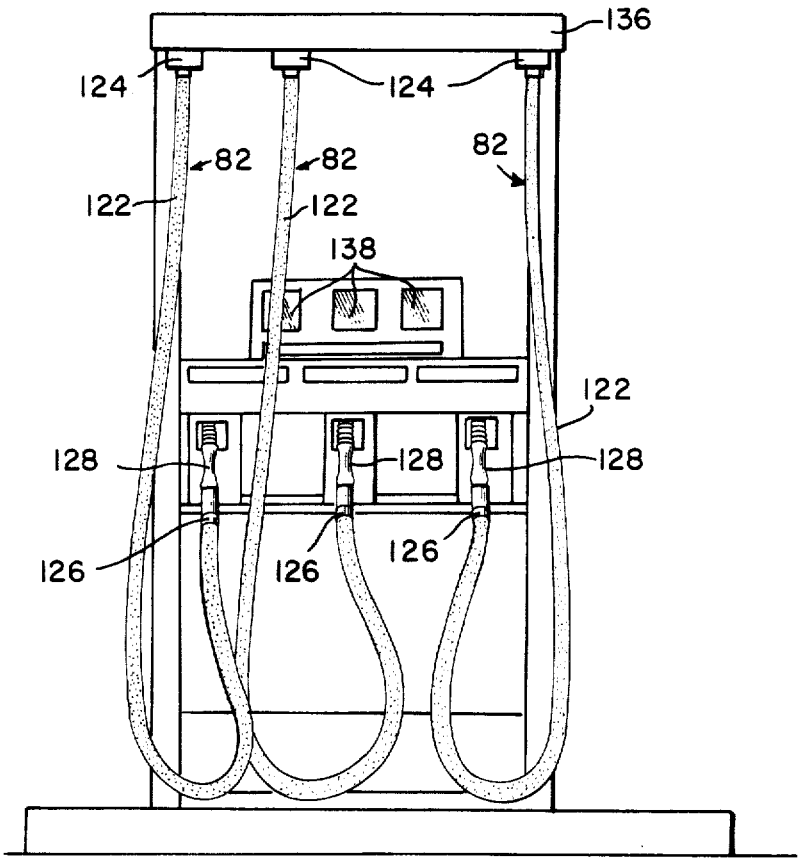
FIG. 7 shows one application of the present invention in a multiple product dispenser system.
Figure 7:
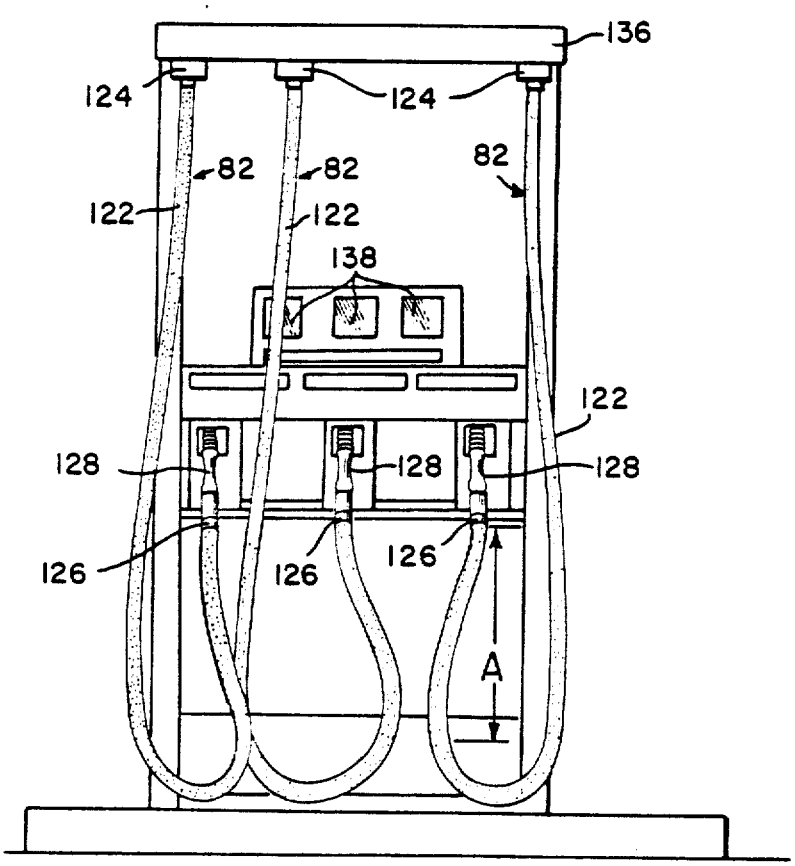

In FIG. 7, a typical multi-product dispenser system for liquid fuel is shown. Assuming that the hoses shown are outer vapor hoses 122, as shown in FIG. 6, connected to nozzles 128, venturi pumps 64 are located as shown in FIG. 6 near the base of the nozzles 128. The dimension "A" represents in this example the positioning for the suction head 116 in the coaxial hose assembly 82. This dimension "A" is determined in consideration of the usual low point of the coaxial hose assembly 82 during the refueling of a vehicle. The gasoline pump housing 136 includes the usual meters 138, and so forth.

Figure 8:
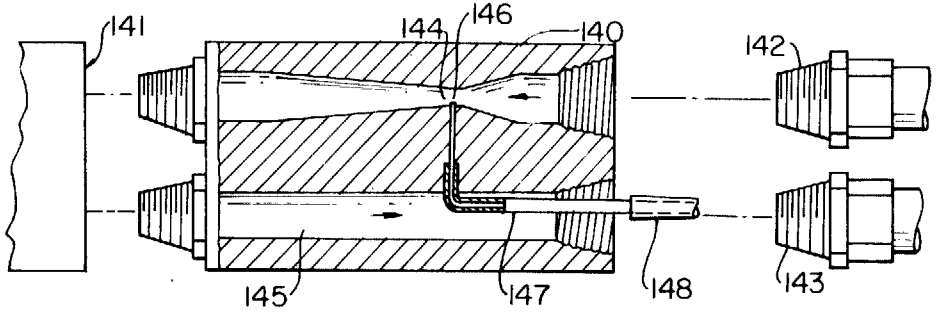
FIG. 8 shows an alternative embodiment of the invention.

Although particular embodiments of the present invention for maintaining a clear vapor path in a vapor recovery hose of a fuel distribution system have been shown and described, other embodiments may occur to those of ordinary skill in the art which fall within the true spirit and scope of the appended claims. For example, as shown in FIG. 8, an alternative embodiment of the invention may include a pump means for non-coaxial product and vapor hoses, whereby a rigid housing 140 installed between the nozzle 141, product hose 142 and vapor hose 143 includes a venturi pump 144, similar to venturi pump 64, located in the fuel flow and a vapor flow path 145 for passing vapor from the nozzle 141 to the vapor hose 143. A rigid tube 147 located in the vapor flow path 145 connects the venturi pump throat opening 146 with a flexible tube 148 which terminates at an area of the vapor hose 143 where fuel is expected to accumulate. A check valve and filter assembly (not shown) similar to the check valve and filter assembly 102 used with venturi pump 64 is installed in a suitable location between the venturi pump throat opening 146 and the flexible tube 148.

What is claimed is:

1. A fuel dispensing system comprising:

nozzle means for dispensing fuel;

a product hose for delivering fuel from a storage tank to said nozzle means via a pump;

a vapor recovery hose coaxial with and containing said product hose, and connected to said nozzle means for providing a vapor path in the space between said product and vapor recovery hoses, for removing vapors developed at said nozzle means during the fueling of a vehicle; and pump means coaxially located in a fuel flow path of said product hose, and operable by and over a range of flow rate of said fuel through said product hose, said pump means including means for sucking fuel into said product hose from an area of said vapor path which tends to be at a low point where fuel may accumulate due to backflow from said nozzle means during a refueling operation, thereby substantially ensuring a clear vapor path.

2. The fuel dispensing system of claim 1, wherein said means for sucking fuel of said pump means includes an inlet port coupled via tubing means to the area of said vapor path of said vapor recovery hose where liquid may accumulate, said tubing means providing a pathway therebetween for evacuating fuel.

3. The fuel dispensing system of claim 2, wherein said pump means includes venturi pump means.

4. The fuel dispensing system of claim 3, where in said venturi pump means include:

an inwardly tapering conical inlet throat relative to the direction of fuel flow having an entry diameter of 0.53 inch, an exit diameter of 0.213 inch, an angle of 12° 15′ with its longitudinal axis measured from its exit end, and a length with respect to its longitudinal axis of 0.720 inch, a central cylindrical portion having a length of 0.10 inch, and a diameter equivalent to the exit diameter of said inlet throat, said inlet port for said venturi pump means including a hole of 0.062 inch diameter through a wall of said cylindrical portion; and an outwardly tapering conical outlet throat having an entry diameter equivalent to that of said cylindrical portion, and exit diameter of 0.50 inch, a length with respect to its longitudinal axis of 2.070 inches, and an angle of 4° with its longitudinal axis measured from its entry end;

said central cylindrical portion connecting the exit end of said inlet throat to the entry end of said outlet throat, in a manner providing a common longitudinal axis therebetween.

5. The fuel dispensing system of claim 1, further including:

antirotational coupling means for coupling said pump means in said product hose in a manner preventing rotation of said pump means with respect to said product hose;

said means for sucking fuel of said pump means including an inlet port coupled via tubing means to the area of said vapor path of said vapor recovery hose where liquid may accumulate, said tubing means being secured to the outside circumference of said product hose, whereby said antirotational coupling means further provides for substantially maintaining the positioning of said tubing means in said vapor path.

6. In a fuel dispensing system including nozzle means for delivering fuel into a vehicle fuel tank, a vapor hose connected to said nozzle means for providing a pathway for vapors developed at said nozzle means during the fueling process for carrying the vapors either to a collection point or an associated central fuel storage tank, and a product hose providing a fuel flow path located within and coaxial with said vapor hose for delivering fuel via a pump from said storage tank to said nozzle means, wherein the improvement comprises:

venturi pump means both located within and coaxial with the fuel flow path of said product hose, said venturi pump means including an inlet port coupled via tubing means for providing a pathway to an area of the vapor path of said vapor recovery hose which tends to be at a low point where liquid fuel may accumulate, due to backflow from said nozzle means during operation of said fuel dispensing system, said venturi pump means being operative over a range of flow rate of said fuel for sucking accumulated fuel via said tubing means from said vapor hose into said product hose for delivery to said nozzle means, thereby ensuring the maintenance of a clear vapor path within said vapor hose.

7. The improvement of claim 6, wherein said venturi pump means further includes spring loaded poppet means within a throat-like constricted area therein, for both providing a small cross sectional flow area for fuel, and controlling the size of said area in direct relationship to the fuel pressure, thereby substantially maximizing the suction force in the low-flow rate range of pumping said fuel.

8. The improvement of claim 6, further including check valve means between said inlet port and said tubing means for preventing fuel flowing from said venturi means to said tubing means.

9. The improvement of claim 8, further including filter screen means located between said check valve means and said tubing means, for filtering suctioned fuel prior to its passage through said check valve means, thereby substantially ensuring long-term reliable operation of the latter.

10. The improvement of claim 6, wherein said venturi pump means includes:

an inwardly tapering conical inlet throat relative to the direction of fuel flow having an entry diameter of 0.53 inch, an exit diameter of 0.213 inch, an angle of 12° 15′ with its longitudinal axis measured from its exit end, and a length with respect to its longitudinal axis of 0.720 inch, a central cylindrical portion having a length of 0.10 inch, and a diameter equivalent to the exit diameter of said inlet throat, said inlet port for said venturi pump means including a hole of 0.062 inch diameter through a wall of said cylindrical portion; and an outwardly tapering conical outlet throat having an entry diameter equivalent to that of said cylindrical portion, an exit diameter of 0.50 inch, a length with respect to its longitudinal axis of 2.070 inches, and an angle of 4° with its longitudinal axis measured from its entry end;

said central cylindrical portion connecting the exit end of said inlet throat to the entry end of said outlet throat, in a manner providing a common longitudinal axis therebetween.

11. The improvement of claim 6, further including antirotation means for coupling said venturi pump means in said product hose in a manner preventing rotation of said venturi pump means with respect to said product hose, thereby substantially ensuring that the positioning of said tubing means is maintained in the area of the vapor path of said vapor reco very hose where liquid fuel may accumulate.

* * * * *

UNITED STATES PATENT AND TRADEMARK OFFICE

CERTIFICATE OF CORRECTION

PATENT NO. : 4,687,033

DATED : August 18, 1987

INVENTOR(S) : Roger W. Furrow, Harold R. Young, Frank Dye

It is certified that error appears in the above-identified patent and that said Letters Patent are hereby corrected as shown below:

Fig. 7, should be deleted to appear as shown on the attached sheet.

Signed and Sealed this

Twenty-eighth Day of June, 1988

*Attest:*

DONALD J. QUIGG

*Attesting Officer*

*Commissioner of Patents and Trademarks*